US005659999A

United States Patent [19]

Benson

[11] Patent Number: 5,659,999

[45] Date of Patent: Aug. 26, 1997

[54] MOVABLE SCREEN PANEL CLOSURE APPARATUS

[76] Inventor: David A. Benson, 8931 Beard Ave. South, Bloomington, Minn. 55431

[21] Appl. No.: 250,815

[22] Filed: May 31, 1994

[51] Int. Cl.[6] ..... E05D 15/06

[52] U.S. Cl. ..... 49/404; 16/72

[58] Field of Search ..... 49/404; 16/71, 16/72, 75, 78

[56] References Cited

U.S. PATENT DOCUMENTS

| | | | |
|---|---|---|---|
| 3,143,773 | 8/1964 | Glenn | 20/19 |
| 3,160,250 | 12/1964 | Bridwell | 189/45 |
| 3,334,444 | 8/1967 | Hargrove | 49/404 |
| 3,389,422 | 6/1968 | Glenn | 16/78 |
| 3,699,608 | 10/1972 | Schwarz | 16/79 |
| 4,003,102 | 1/1977 | Hawks et al. | 16/72 |
| 4,004,372 | 1/1977 | Beard et al. | 49/404 |
| 4,126,912 | 11/1978 | Johnson | 16/81 |
| 4,301,623 | 11/1981 | Demukai | 49/404 |
| 4,330,960 | 5/1982 | Hasemann et al. | 49/404 |
| 4,462,437 | 7/1984 | Prada | 16/72 X |
| 4,675,938 | 6/1987 | Bundschuh | 16/63 |
| 4,783,881 | 11/1988 | Ho | 16/72 |
| 4,819,295 | 4/1989 | Kaftan | 16/72 |
| 4,884,369 | 12/1989 | Tatham | 49/404 |
| 4,891,911 | 1/1990 | Yung | 49/404 |
| 5,131,188 | 7/1992 | Hutchison et al. | 49/404 |
| 5,251,402 | 10/1993 | Richardson et al. | 49/404 |
| 5,285,596 | 2/1994 | Kinsey | 49/404 |
| 5,365,636 | 11/1994 | Jensen | 16/72 X |

*Primary Examiner*—Kenneth J. Dorner
*Assistant Examiner*—Jerry Redman
*Attorney, Agent, or Firm*—Anthony G. Eggink

[57] ABSTRACT

An automatic closure assembly for a sliding panel, particularly of the screen door type, is disclosed. One or more power springs, operable in their linear ranges are mounted within a compact housing configured for ready attachment to a surface adjacent the sliding panel. The springs apply tension to a cord wound on a take-up reel within the housing. One end of the cord is screwed to the sliding panel such that as the panel is moved in an opening direction, the power spring(s) are wound in tension to apply closure forces to the panel. Different selections are provided for enabling an operator to select a plurality of different discrete tension forces to be applied by the closure assembly to the sliding panel.

21 Claims, 9 Drawing Sheets

MOVABLE SCREEN PANEL CLOSURE APPARATUS

FIELD OF THE INVENTION

This invention relates generally to closure apparatus, and more particularly to an automated closure apparatus for sliding panels of the sliding window or patio door type.

BACKGROUND OF THE INVENTION

While the principles of this invention apply to the automated closing of sliding window or door panel members in general, it is particularly applicable to the closing of sliding screen doors. Therefore, in order to simplify the following discussion, the invention will be described with respect to its applicability to sliding window or door panels of the screen type. The screen member of a sliding door is generally operable to obstruct the door opening when the sliding glass portion of the door is "open," and is slidable in or between oppositely disposed upper and lower tracks in a direction parallel to and in close proximity with the glass door panel so as to leave the access portion of the door opening unobstructed when slid entirely to its "open" position. There are numerous occasions wherein it is desirable for the movable screen door portion to "automatically" return to its closed position following the entrance or exit of a person or animal through the door opening. For example, it may be desirable to immediately close the door panel in order to keep animals or small children on one side of the screen panel, while maintaining insects and the like on the other side. Further, it may be desirable for a person carrying an object or objects to open and pass through the sliding screen door, without being required to put down the objects or being required to balance such objects while working free a hand in order to close the screen panel behind him/her.

Many attempts have been made over the years to provide an acceptable closure mechanism for slidably movable screen panels for gliding windows or sliding doors, often referred to as patio doors. While the principles of operation are generally the same for window and door screens, the closure of door screens is much more difficult due to their size and frequency of use. Previous attempts have generally fallen short of simultaneously providing the most desired features for such a closure apparatus, namely: simplicity; ease of manufacture, use and installation; ability to retrofit to existing installed structures; low cost; smooth and efficient operation; versatility and adaptability to variously sized window or door panels; pleasing aesthetics; uniform and properly tensioned closure force; adjustable closure tension; and above all—high reliability over the operative life of the movable panel.

Prior attempts at sliding panel closure apparatus have generally proved to be cumbersome or have required uniquely designed window or door frame configurations, and/or have exhibited low reliability and fairly short operative life. For example, the device illustrated in U.S. Pat. No. 4,301,623 requires a sliding door panel to have a specially designed frame portion for enclosing the tension spring closure apparatus. A similar closure assembly, configured to be housed within the building wall structure or configured as a cumbersome elongated device attached to the movable screen member, is illustrated in U.S. Pat. No. 4,003,102. Yet another bulky and unsightly closure mechanism which uses a complicated block and tackle pulley arrangement is illustrated in U.S. Pat. No. 4,819,295. Such configurations generally do not satisfy the desired simplicity, pleasing aesthetics or low-cost requirements for such closure apparatus.

Besides the need for an aesthetically pleasing closure housing which is easy to attach and retrofit to an existing door or window structure, such closure mechanism should be operable in a manner so as not to obstruct the door or window passageway when the door or window is positioned in an "open" position. A closure apparatus such as disclosed in U.S. Pat. No. 4,675,938 places the closure device and its associated cable assembly near the top of the door but partially obstructs the door passageway in an unsightly and potentially dangerous manner. Other closure configurations such as illustrated in U.S. Pat. No. 5,131,188 enclose the closure mechanism within the upper frame assembly of the door or within a detent portion of the screen door frame. Such closure structures which apply closure pressure to either the top or the bottom of the sliding door member are generally ineffective and make the screen panel susceptible to binding due to the tendency of the panel to tilt or cock between the frame tracks during operation.

Many prior door closure members have utilized some type of a spring assembly for providing the necessary closure force to the slidable panel. One type of spring has been the simple coiled tension spring, which in order to be operatively effective over the entire door movement distance, requires significant longitudinal length and is difficult to conceal or house for retrofit applications. Others have used spring configurations referred to as constant force springs, which have proven to have low reliability and high susceptibility to breakage over extended periods of use.

The present invention addresses the above shortcomings of prior window or door closure structures. This invention uses a unique spring configuration and combines the best features of prior closure structures to simultaneously provide a highly reliable, aesthetically pleasing, simple, low-cost, easy to use and install, adjustable tension, and universally applicable automatic movable panel closure member which provides generally uniform pressure to the movable panel member throughout its entire closure movement and which consistently enables the movable panel to close in a smooth and uniform manner over the operative life of the panel.

SUMMARY OF THE INVENTION

The present invention provides a user friendly and easy to install automatic closure apparatus for sliding panels and is particularly useful for application to closing sliding screen doors. This invention provides for operator selection of the closing force to be applied to the sliding panel. By simply moving a selection member, in switch-like manner, an operator can select that closure force that is most appropriate for the particular door or panel with which the apparatus is to be used. The selectable nature of the closure force can be provided by a single power spring coupled with a selectable gear reduction device (or other appropriate selection means) for applying all or a part of the spring's force to the door panel. Alternatively, a plurality of power springs which are selectively engaged singly or in various combinations may be used to provide the desired closure force.

Therefore, according to one aspect of the invention there is provided an automatic closure apparatus for a sliding panel of the type mounted for sliding movement relative to an opening, comprising: a cord retainer sized and configured for attachment to a first edge of the sliding panel and configured to retainably engage and hold the end of a cord; and a closure assembly sized and configured for attachment to a nonmovable object adjacent to that side of the opening addressed by said first edge of the sliding panel when positioned so as to close the opening, including: a housing defining an internal cavity and a cord opening; said housing being configured for mounting to said nonmovable object; a take-up reel mounted within said housing for rotation about an axis and suitable for accepting a wound length of cord thereon; a cord initially wound on said take-up reel and passing through said cord opening to an end suitable for securement by said cord retainer; and at least one power spring located within said housing and cooperatively engaging said take-up reel, such that said power spring is placed in tension as said take-up reel rotates to release the wound cord therefrom thereby applying torque to said take-up reel for retracting said cord back onto the reel; said power spring being mounted and selected for operation in its generally linear torque range for the maximum operable length of cord to be withdrawn from said take-up reel for a panel closing operation.

Such closure apparatus may further include a plurality of said power springs operatively connectable to said take-up reel; and mechanical selection means mounted to said housing for selectively operatively engaging said plurality of power springs to said take-up reel for selectively changing the torque applied by said power springs to said take-up reel. Alternatively, such closure apparatus may include mechanical selection means having gear reduction means mounted within said housing for selectively operably changing the torque applied by said power spring to said take-up reel.

According to yet another aspect of the invention, there is provided an automatic closure apparatus for a sliding door panel, comprising: a compact housing configured for unobtrusive mounting to a surface other than on the door panel to be closed; a cord; a take-up reel means rotatably mounted to said housing for releasably holding said cord for withdrawal from and retraction back into said housing; a power spring rotatably mounted to said housing; coupling means for operatively interconnecting said power spring for movement with said take-up reel such that said power spring applies rotational torque forces to said take-up reel whenever said reel has been rotated due to cord withdrawal therefrom from an initial full cord retraction position; and means for connecting said cord to a sliding door panel wherein said cord is withdrawn from said take-up reel when said panel is moved in an opening direction and is retracted by said reel when said door is moved in a closing direction.

While the invention will be described with regard to various preferred embodiments of the invention, it will be understood that the invention is not to be limited by the use of such embodiments or to any of the sizes or parameters of the parts and components disclosed, other than as recited in the claims annexed hereto and forming a part hereof.

BRIEF DESCRIPTION OF THE DRAWING

Referring to the Figures, wherein like numerals represent like parts throughout the several views.

DETAILED DESCRIPTION OF THE INVENTION

Figure 1:
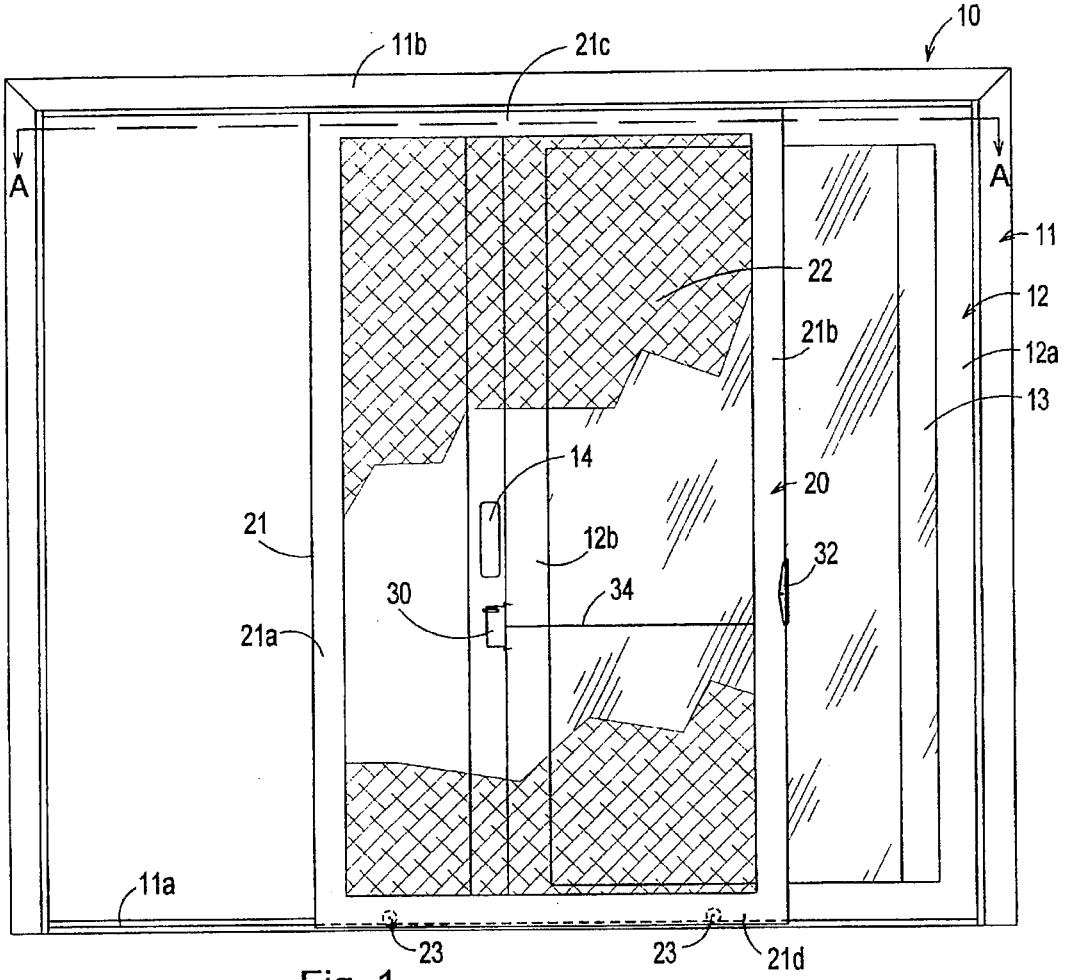
FIG. 1 is a diagrammatic front view of a typical sliding glass door assembly, with portions of the screen mesh broken away, employing the automatic panel closure principles of this invention.

While the principles of this invention apply equally well to the closing of any sliding panel assembly, whether used with a door or window assembly, for simplification of the following discussion, reference will be had only to applicability of the invention to the closing of a screen panel for a sliding glass patio door assembly. It will be understood that the following description of preferred embodiments of the invention are intended to represent only examples of preferred techniques for practicing the broad principles of the invention. Referring to FIG. 1, a typical sliding glass door assembly of the type with which the closure apparatus of this invention is particularly useful for sliding the screen portion thereof, is generally illustrated at 10.

The sliding glass door assembly 10 generally includes a peripheral rectangular frame 11 operatively housing a fixed glass panel 12 and a slidable glass panel 13. The slidable glass panel 13 has outer and inner handles 14 and 15 respectively for facilitating movement of the slidable glass panel 13. The bottom or sill portion of the frame 11 is typically formed or extruded so as to form a plurality of raised portions defining grooves or tracks, generally designated at 11*a*, longitudinally extending between the pair of upright portions of the frame 11. The upper jam portion 11*b* of the frame 11 similarly defines a plurality of grooves or tracks cooperatively aligned in opposed manner with the lower tracks 11*a* for cooperatively engaging the glass panel 13 and a screen panel 20 for longitudinal sliding movement therebetween, in manner well-known in the art. The fixed glass panel 12 has a first upright frame portion 12*a* secured for weathertight engagement with one of the upright members of the frame 11, and a second upright in-board frame member 12*b* vertically extending between the upper jam and lower sill portions of the frame 11, and serves as a mounting support for the closure housing assembly, as hereinafter described in more detail.

The slidable screen panel 20 simply comprises a peripheral frame 21 across which is stretched an insect screen mesh 22. The screen panel frame 21 generally includes a leading upright frame member 21*a*, a trailing upright frame member 21*b*, an upper frame portion 21*c* and a lower frame portion 21*d*. The lower frame member 21*d* generally includes a plurality of nylon rollers 23 which guide the screen panel 20 along the lower track 11*a* of the door assembly. Such door and screen panel assembly is well-known in the art, and will not be belabored herein. It will be understood by those skilled in the art that while not shown, such door assemblies include appropriate seals and other features for providing weathertightness to the assembly. It will also be understood by those skilled in the art, that such door assemblies can be constructed of numerous different types of materials such as wood, vinyl, plastics, aluminum, or the like. This invention applies to such sliding door configurations of any type having a screen panel longitudinally movable along the upper and lower tracks of the door assembly.

Figure 6:
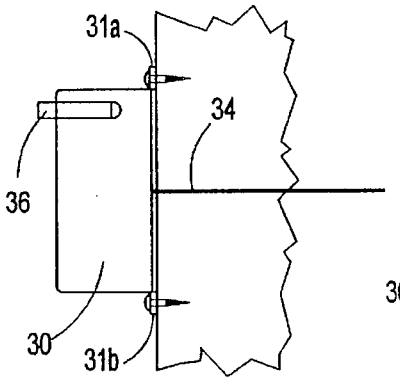
FIG. 6 is an enlarged front view of the closure housing assembly portion of FIG. 1.

The closure apparatus of this invention generally includes a closure housing assembly 30 having upper and lower mounting flanges 31*a* and 31*b* respectively, and a separate cord retainer bracket 32. The closure housing apparatus 30 is generally vertically aligned with and is fixedly secured by a pair of screws passing through its upper and lower mounting flanges 31*a* and 31*b* to the in-board or left vertical frame member 12*b* of the fixed glass panel 12, as illustrated in FIGS. 1 and 6. The cord retainer bracket 32 is vertically aligned at the same general height as the closure housing apparatus 30 and is secured to the trailing upright member 21*b* of the screen panel frame 21, as shown in FIG. 1. The cord retainer bracket 32 is secured to the screen panel frame member 21*b* by any appropriate fastener, preferably by a sheet metal or wood screw fastener. The closure housing apparatus 30 and the cord retainer bracket 32 are operatively interconnected by means of a cord or cable member 34 biased for retraction within the closure housing apparatus 30, in manner to be hereinafter described in more detail. The cord or cable 34 may be of any appropriate material but is in the preferred embodiment is made of high strength, lightweight monofilament or nylon material. The width of the closure housing apparatus 30 is sized (see FIGS. 7 and 8) somewhat narrower than the thickness of the in-board frame member 12*b* of the fixed glass panel 12 so as not to interfere with movement of the sliding glass panel 13. Further, when operatively mounted to the fixed glass panel 12, the closure housing apparatus 30 is laterally positioned relative to the width of the in-board upright frame member 12*b* of the fixed glass panel 12 such that the outwardly facing surface of the closure housing apparatus 30 generally lies coplanar but slightly outwardly extended from the general outer plane of the fixed glass panel frame. Such alignment allows unimpeded motion of the cord 34 out of and into the closure housing 30, as hereinafter described in more detail.

While the closure housing 30 may be positioned at any height along the in-board upright frame member 12*b* of the fixed panel 12, the preferred height is about one-third of the vertical distance between the lower track 11*a* and the upper jam 11*b*. Obviously, if the outer handle 14 of the slidable glass panel 13 is an outwardly projecting type of handle as illustrated in the figures, the closure housing 30 should be appropriately placed so as not to engage or impede movement of the outer handle 14 relative thereto.

Figure 2:
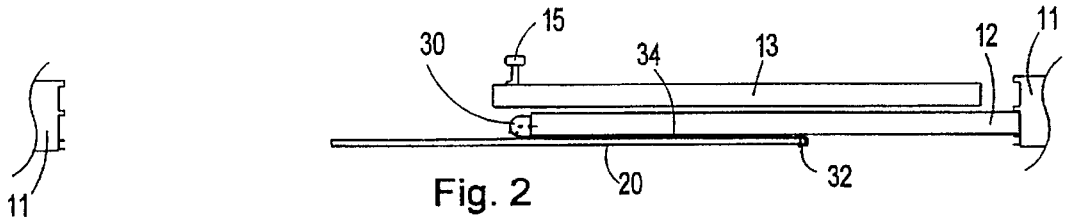
FIG. 2 is a diagrammatic top view of the door and screen panel members of the door assembly of FIG. 1 as generally viewed along the Line A—A of FIG. 1, and with the outside handle of the movable glass door panel removed.

A better understanding of the relative movements of the slidable glass panel 13 relative to the fixed glass panel 12 and of the slidable screen panel 20 relative to the fixed panel 12 can be had with reference to FIGS. 2–5. Referring thereto, the closure apparatus is illustrated as it would operatively appear as connected to the slidable glass panel 13 and the slidable screen panel 20 in various positions. FIG. 2 illustrates in top view the relative positions of the movable panels as shown in FIG. 1, wherein the slidable glass panel 13 is fully opened and the slidable screen panel 20 is partially opened. It will be noted in FIGS. 2, 4 and 5, the outer handle 14 has been deleted so as not to obscure view of the underlying closure housing 30.

Figure 3:
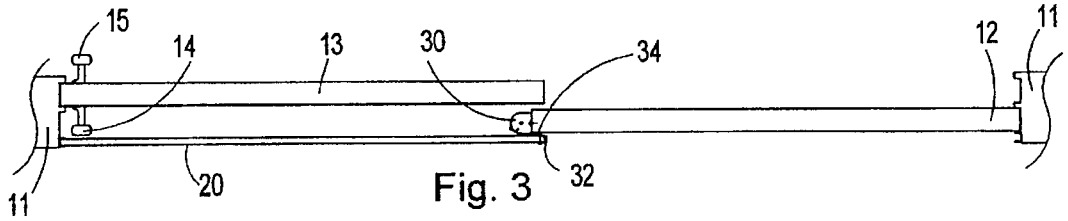
FIG. 3 is a diagrammatic view of the door and screen panel members similar to that of FIG. 2, illustrating them as they would appear with the movable sliding glass door and screen panel members in their fully closed positions.
Figure 4:
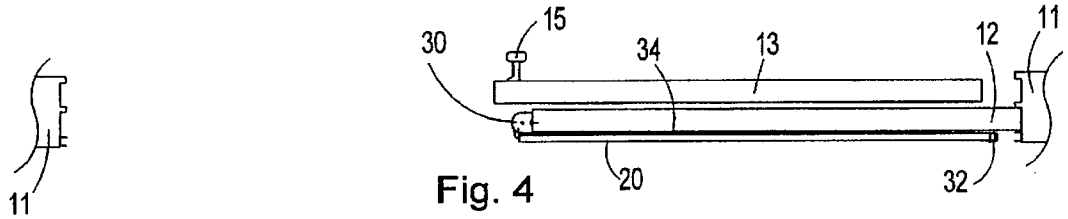
FIG. 4 is a diagrammatic view of the door and screen panel members similar to that of FIG. 2, illustrating them as they would appear with the movable sliding glass door and screen panel members in their fully open positions, with the outside door handle removed and with the closure assembly positioned to hold the screen panel in its open position.
Figure 5:
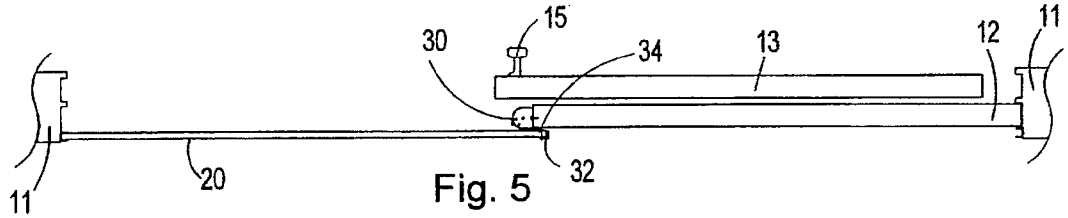
FIG. 5 is a diagrammatic view of the door and screen panel members similar to that of FIG. 2, illustrating them as they would appear with the movable sliding glass door member in its fully open position and its outer door handle removed, and with the screen panel member in its fully closed position.

FIG. 3 illustrates both the slidable glass panel 13 and the slidable screen panel 20 as they would respectively appear in their closed positions. FIG. 4 illustrates the slidable glass panel 13 and the slidable screen panel 20 as they would respectively appear when positioned in their fully open positions. FIG. 5 illustrates the slidable glass panel 13 in a fully open position and the slidable screen panel 20 in a fully closed position.

Figure 7:
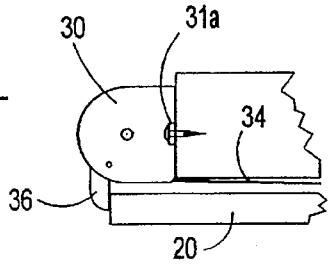
FIG. 7 is an enlarged top view of the closure housing assembly portion of FIG. 4.
Figure 8:
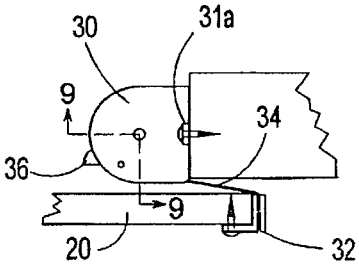
FIG. 8 is an enlarged top view of the closure housing assembly portion of FIG. 5.

The closure housing apparatus 30 includes a door catch member 36 that can be manually pivoted and positioned between extended and retracted positions. When in a normally retracted position, as illustrated in FIG. 8, the slidable screen panel 20 is free to move relative to the closure housing apparatus 30. However, when the screen panel 20 is positioned in its fully open position and the door catch member 36 can be pivoted to its extended position, as illustrated in FIG. 7. In its extended position, the door catch member 36 retainably holds the screen panel 20 in its open position against the bias of the cord or cable 34 and its associated biasing means, as hereinafter described in more detail.

The closure housing apparatus 30 generally houses a take-up spool assembly for the closure cable 34 and biasing means connected to the take-up spool assembly for providing the desired pull or tension on the closure cable. As the slidable screen panel 20 is manually moved toward an open position, cable 34 the end of which is retained by the cable retainer bracket 32, is withdrawn from the closure housing 30 against the bias of a spring. The bias force or tension applied the cord must be sufficient enough to overcome the inertial weight and sliding frictional forces of the sliding panel, in order to efficiently and smoothly close the door but not so large as to create a danger by closing the door too abruptly. It is desirable that the force exerted through the cable for closing the screen panel be relatively uniform or constant across the entire movement range of the slidable screen panel. To accomplish this task, the present invention employs one or more "power" torsion springs. Such power springs are well-known to those skilled in the art and exhibit particularly high reliability over extended periods of use. While exhibiting a relatively linear torque curve versus the number of turns, the "power" spring should not be confused with other "spiral" springs of the so-called "constant force" variety or spool springs which are known to exhibit a relatively short operative life. Power springs suitable for use with this invention are supplied by such manufacturers as Sandvik Inc. and Vulcan Spring and Manufacturing Co.

Further, in order to make the closure apparatus suitable for retrofitting sliding glass door assemblies of varied shape and configuration, it is desirable to be able to selectably adjust the pull or closure tension applied through the cable 34 so as to uniquely adapt such closing tension to the specifications and peculiarities of the particular door assembly with which the invention is to be used. Also, since such closure parameters of a door assembly can and most often do change over time and with use of the door assembly, such adjustability feature enables the closure apparatus to readily accommodate such changes in required closure tension due to wear, environmental conditions or the like.

A preferred embodiment of closure apparatus practicing the principles of this invention provides for three selectable tension forces. While several preferred embodiments of such adjustable tensioning apparatus will be disclosed, it will be understood by those skilled in the art, that the invention is not to be construed as limited to the specific embodiments which are shown, but that the principles of the invention apply equally well to any number or combination of tension forces, and to techniques for creating varied selectable tension forces other than described herein.

Figure 9:
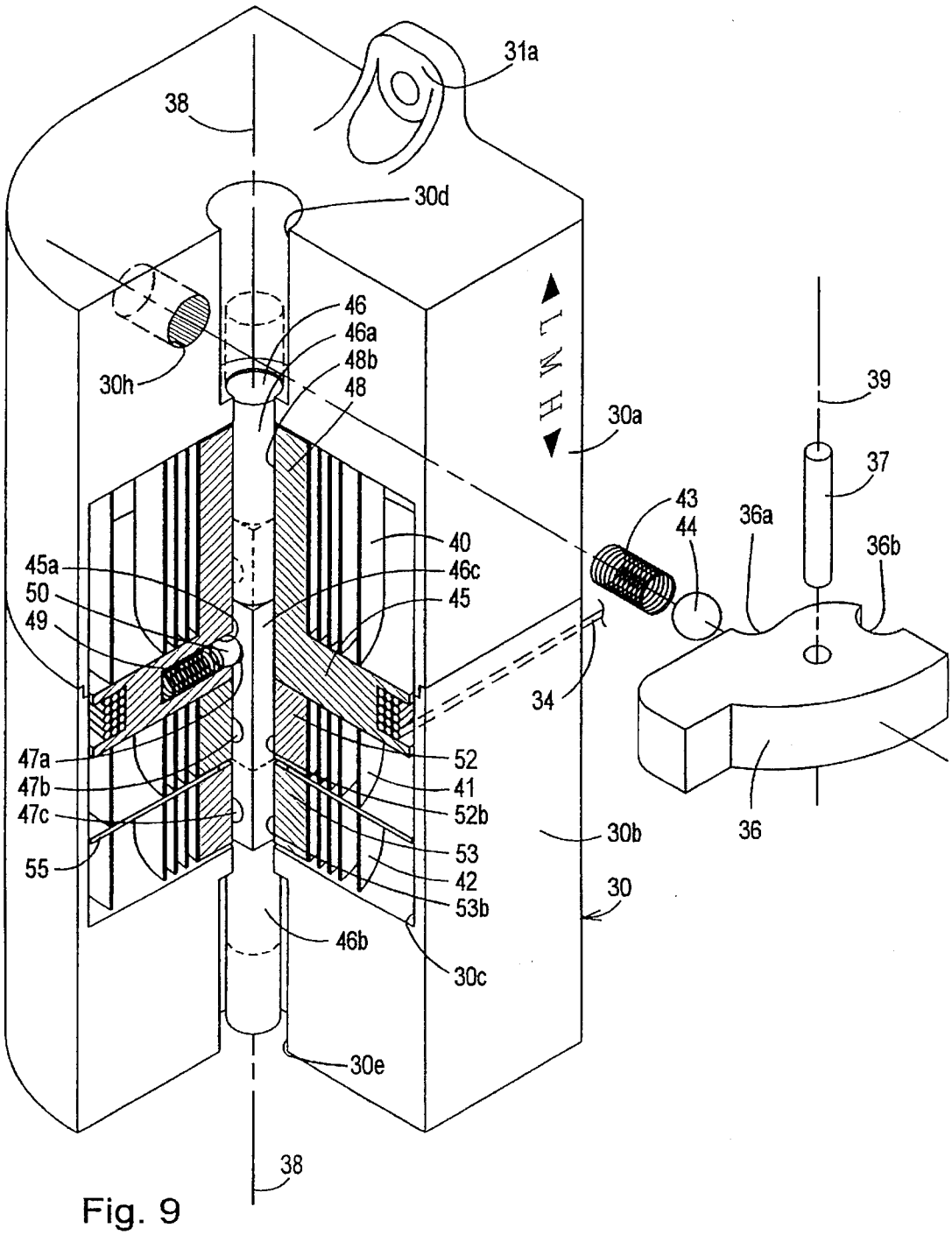
FIG. 9 is an enlarged generally quarter-sectional perspective view of a first embodiment of the closure housing assembly of FIG. 8, taken generally along the Line 9—9 of FIG. 8, with the door catch and biasing portions thereof separated for clarity therefrom.
Figure 10:
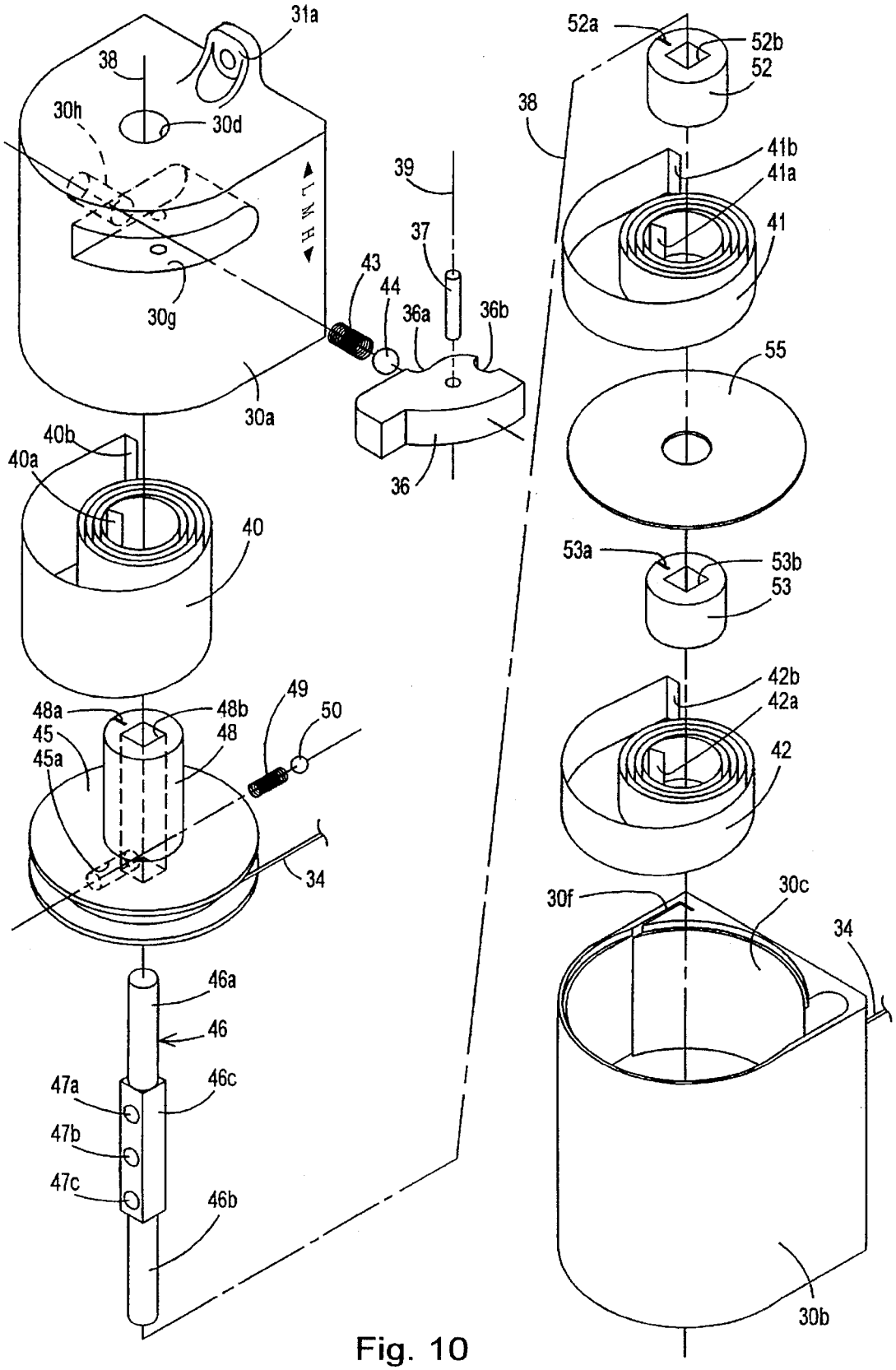
FIG. 10 is an exploded diagrammatic isometric view of the closure housing assembly of FIG. 9.

Referring to FIGS. 9 and 10, a first embodiment of an adjustable closure assembly is illustrated. This embodiment of the closure apparatus uses a primary or main power spring 40 and first and second auxiliary power springs 41 and 42 respectively for selectively providing adjustable bias force to the cord or tension cable 34.

The housing 30 generally houses the power springs 40, 41 and 42 and their associated components in a manner so as to bias a take-up spool or reel 45 upon which is wound the cord or cable 34. The housing comprises upper and lower housing portions 30a and 30b which cooperatively mate and which are appropriately secured together to define an inner cavity 30*c*. Axially aligned upper and lower cylindrical holes 30*d* and 30*e* are respectively formed through the upper and lower housing portions 30*a* and 30*b* and open into the inner cavity 30*c*. The lower housing also defines a cord exit hole through which the cord or cable 34 passes as it is drawn from or retracted by the take-up spool 45. The end of the cord has an enlarged clip member attached thereto which is sized to prevent retraction of the end of the cord back through the cord exit hole, and which enables a user to readily grasp the end of the cord and to secure the cord end to the cord retainer bracket 32. Components within the housing cavity 30*c* are generally centered about and along a central axis 38 which passes through the cylindrical holes 30*d* and 30*e*, as illustrated in FIGS. 9 and 10. A spindle 46 is configured for axial alignment with the central axis 38. The spindle 46 has upper and lower cylindrical end portions 46*a* and 46*b* continuously interconnected by a central square or spline key portion 46*c*. The upper and lower cylindrical ends 46*a* and 46*b* of the spindle 46 are cooperatively slidably engaged and entrained within the upper and lower cylindrical hole shoulder portions 30*d* and 30*e* of the housing 30, enabling the spindle 46 to axially slide, along axis 38, relative to the housing 30. The central rectangular key portion 46*c* of the spindle 46 includes three semispherical detent holes or notches 47*a*, 47*b* and 47*c*.

The upper portion of the take-up spool or reel 45 is integrally connected to or forms a primary or main spring arbor 48 which is generally cylindrical in shape and has an elongated slot 48*a* longitudinally formed in its outer surface for entraining a first end 40*a* of a primary or main spring 40, which is spirally wound around the arbor 48. The arbor 48 has an axially aligned rectangular opening or keyway 48*b* formed therethrough which is sized to cooperatively slidably mate with the central rectangular key section 46*c* of the spindle 46 in a manner such that the arbor 48 and connecting reel or spool 45 are commonly turned or rotated with the spindle 46 when the spindle's rectangular key section 46*c* is operatively engaged with the arbor's central keyway 48*b*. The rectangular passage or keyway 48*b* axially continuously extends through the lower reel or spool portion 45. The inner disk portion of the cable reel 45 has a radially aligned cylindrical hole 45*a* extending from and opening into the central keyway 48*b*, which is sized and configured to retainably hold a detent spring 49 and associated detent ball 50. The outer end 40*b* of the primary or main spring 40 is operatively engaged within an L-shaped retaining slot continuously extending from the inner cavity 30*c* of the upper housing portion 30*a* (not illustrated, but forming a continuous extension of the L-shaped retaining slot 30*f* of the lower housing portion 30*b*). When assembled within the inner cavity 30*c* of the housing 30, the reel 45 and arbor 48 assembly is axially mounted to the spindle 46 as illustrated in FIG. 9, such that counterclockwise rotation of the reel or spindle caused by withdrawal of the cord or cable 34 from the reel, operatively winds or tightens the spring 40. It will be understood that all rotational directions referred to herein are as viewed from the top of the respective assemblies as presented in the drawings. When the spindle 46 is positioned as illustrated in FIG. 9, the detent ball 50 as biased by the detent spring 49, operatively aligns with and engages the uppermost detent notch 47*a* of the spindle.

The first and second auxiliary power springs 41 and 42 are respectively wound about spring arbors 52 and 53. The arbors 52 and 53 are generally cylindrical members having longitudinally extending slots 52*a* and 53*a* respectively formed within their outer surfaces for retainably engaging the inner ends 41*a* and 42*a* respectively of the first and second auxiliary springs 41 and 42. The arbors 52 and 53 define rectangular axial inner passageways or keyways 52*b* and 53*b* respectively which are sized to cooperatively slidably mate with the rectangular central section 46*c* of the spindle 46. When mounted on their respective arbors, the outer ends 41*b* and 42*b* of the auxiliary power springs 41 and 42 are retainably engaged within the spring retaining slot 30*f* of the lower housing portion 30*b* such that springs 41 and 42 are tightened or wound when their respective arbors 52 and 53 are rotated in a counterclockwise direction as driven by the spindle key section 46*c*. A spacer disk 55 is positioned to separate the auxiliary springs 41 and 42 and has a central opening therethrough sized large enough so as to not operatively engage the spindle 46. In the preferred embodiment, all of the springs 40, 41 and 42 are 0.005 inches thick and 100 inches long. The primary spring 40 is about 0.75 inches wide, and the auxiliary springs 41 and 42 are 0.3125 inches wide.

The upper housing member 30*a* defines a pie-shaped opening 30*g* which opens to the outer surface of the upper housing member 30*a*, but which does not radially extend to the cylindrical passageway 30*d*, for housing the door catch cam member 36. The door catch member 36 is pivotally secured within the slot or opening 30*g* of the upper housing member 30*a* by means of a catch pin 37 having an axis 39, as indicated in FIG. 10. The door catch member 36 defines a curved cam surface 36*a* on one surface thereof which continuously extends to a detent notch 36*b*. The upper housing member 30*a* further defines a transversely oriented cylindrical hole 30*h* sized to cooperatively hold a catch ball 44 and its associated coil catch spring 43 in a manner such that the catch spring 43 biases the catch ball 44 against the cam surface 36*a* or the detent notch 36*b* of the door catch member 36, depending upon the state of rotation of the door catch member about the axis 39 of the catch pin 37. When rotated in a fully clockwise position, the catch member 36 is positioned such that the catch ball 44 engages its cam surface 36*a* so as to releasably hold the catch member in such position. In such position, the catch member 36 is oriented so as not to interfere with movement of the sliding screen panel, as indicated in FIG. 8. When the catch member 36 is rotated one-quarter of a turn in the counterclockwise direction, it will be positioned such that the catch ball 44 is operatively engaged, as urged by the bias of catch spring 43, into engagement with the detent notch 36*b*. In such position, the catch member 36 is operative to releasably engage the forward end of the screen panel 20, as illustrated in FIG. 7, to hold the screen panel in an open position.

The first embodiment of the invention provides for rapid adjustable selection of the tension provided to the cord or cable 34 by simply axially moving the spindle 46 to one of three positions as defined by the spaced detents 47*a*, 47*b* and 47*c* in the spindle. The spindle 46 can be readily axially pushed to the desired position within the housing 30 simply by axially inserting a round object such as a pencil, screwdriver, nail or the like into either of the holes 30*d* and 30*e* (depending upon in which direction the spindle is to be moved) and pushing against the selected end of the spindle 46. As the spindle 46 moves in the axial direction, the user will be able to detect when the spindle detents engage the detent ball 50, since there will be a noticeable "clicking sound" and/or jerking interruption to the smooth axial movement of the spindle when the detent ball 50 engages a detent depression 47. In essence, the spindle 46 acts as a mechanical switch as it is moved between the three detent positions, to operatively select different ones of the power springs 40, 41 or 42 to the take-up spool 45, thereby selectively changing the tension applied to the cord 34.

Referring to FIG. 9, when the spindle 46 is positioned in its downmost position as illustrated, and with the detent ball 50 in operative engagement with the upper detent notch 47*a*, the central square key section 46*c* of the spindle 46 will simultaneously operatively engage all three of the power springs 40, 41 and 42. As the cord 34 is pulled or withdrawn from the housing in order to engage the end of the cord with the cord retainer bracket 32, the take-up reel 45 will rotate in a counterclockwise direction. The engagement of the take-up reel or spool 45 with the central square key portion 46*c* of the spindle 46 will cause the spindle to rotate in the counterclockwise direction with the take-up reel. The square key portion 46c of the spindle 46 will simultaneously drive or rotate the arbors 52 and 53 of the auxiliary power springs 41 and 42 for common rotation with the spindle 46, thereby causing all three of the springs 40, 41 and 42 to be tightened or wound in tension as the cord or cable 34 is withdrawn. Since the end of the cord 34 is connected to the cord retainer bracket 32 which is mounted to the trailing member 21*b* of the movable screen panel 20, withdrawal of the cord 34 from the housing 30 represents an "opening" of the screen panel in its sliding door assembly 10 (see FIG. 1). When opening pressure is released from the screen panel 20, the selected springs 40, 41 and 42 that have been engaged and tightened in the cord withdrawal process will exert their combined tensioning forces through the cable 34 to the cord retainer bracket 32 and the movable screen panel 20, to cause the screen panel 20 to move in a closing direction. When an operator releases the screen panel 20 after an opening operation thereof, the engaged tensioned or wound "power" springs 40, 41 and/or 42 will exert torsional forces through their respective arbors to the spindle 46 and the take-up reel 45 to move the take-up reel in a clockwise direction, thereby rewinding or retracting the cable 34 back into the housing 30, and closing the screen panel 20. Obviously, the greatest tension is applied through the cord 34 and to the movable screen panel 20 when all three of the springs 40, 41 and 42 are connected for movement by the spindle 46.

As the spindle 46 is axially moved in its upward direction (FIG. 9) until the detent ball 50 operatively engages the middle detent notch 47*b*, only the primary power spring and the first auxiliary power spring 41 will be engaged. Similarly, if the spindle 46 is further raised to its uppermost position such that the detent ball 50 operatively engages the lowermost detent notch 47*c*, the spindle will operatively engage for rotation only the main or primary power spring 40. It will be understood that the amount of spring tension applied to the cable 34 will depend not only upon the spring parameters but also upon the sizes of the spring arbors and space available in the housing cavity 30*c*, which can be cooperatively selected and designed to accommodate screen panels of varied size, weight and moving friction.

The preferred range of closure force provided by a closure assembly of this invention to the cord 34 is from about 1 to 3 pounds and more preferably from about 1 to 4 pounds. In the preferred embodiment, the spring tension applied through the cord 34 when only the primary power spring 40 is engaged is preferably from about 1–1.4 pounds and more preferably about 1.25 pounds. The preferred spring force applied through the cord 34 when both the primary power spring 40 and the first auxiliary power spring 41 are engaged is from about 1.4–2 pounds and more preferably about 1.85 pounds. In the preferred embodiment, when all three power springs 40, 41 and 42 are operatively engaged, the tension applied through the cord 34 is preferably about 1.8–2.7 pounds and more preferably about 2.5 pounds. In the preferred embodiments illustrated, the power spring arbors are about 0.5 inches in diameter and the inner housing dimensions are 1.5 inches in diameter.

Figure 11:
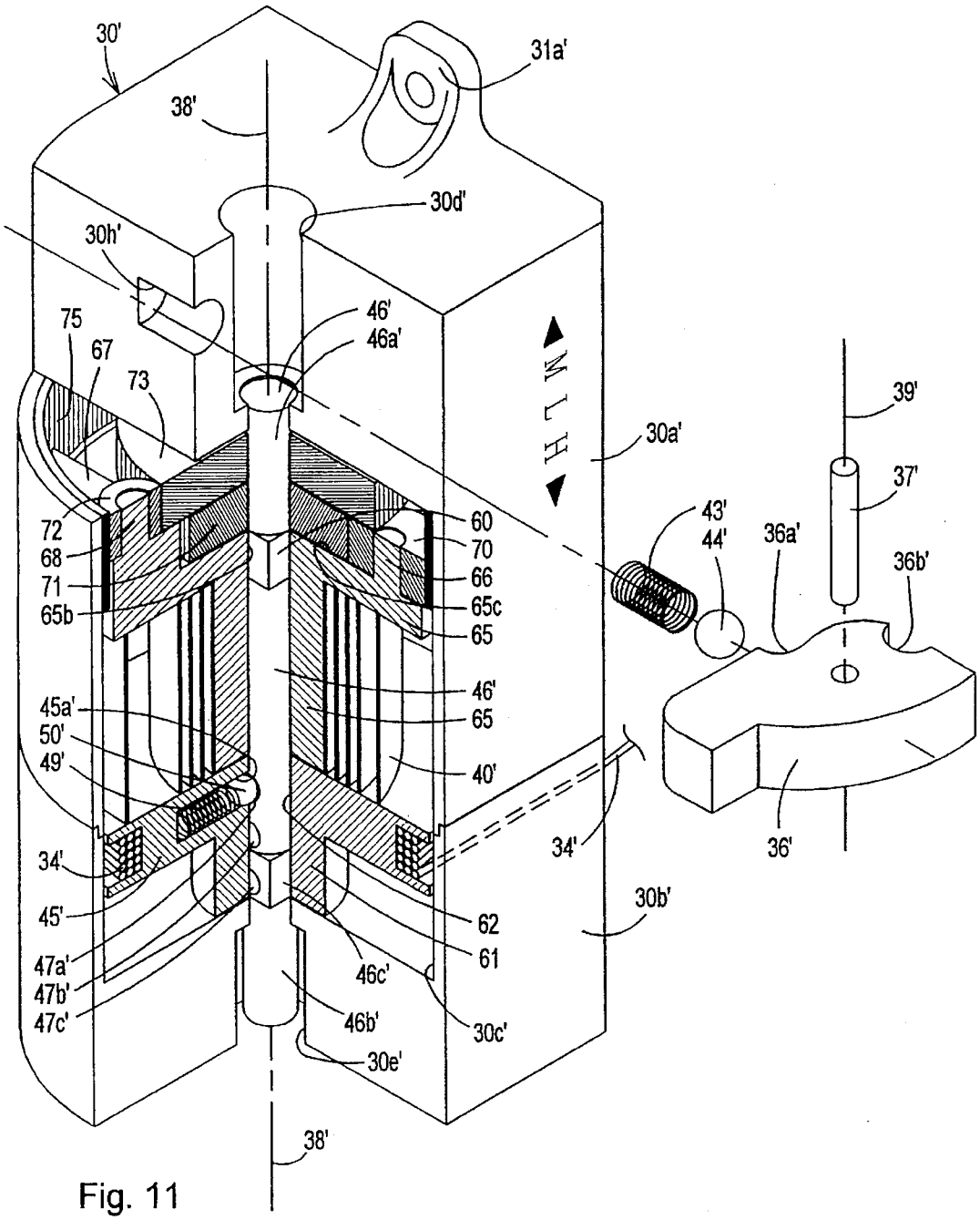
FIG. 11 is an enlarged generally quarter-sectional isometric view similar to that of FIG. 9, of a second embodiment of the closure housing assembly of FIG. 8, with the door catch and biasing portions thereof separated for clarity therefrom.
Figure 12:
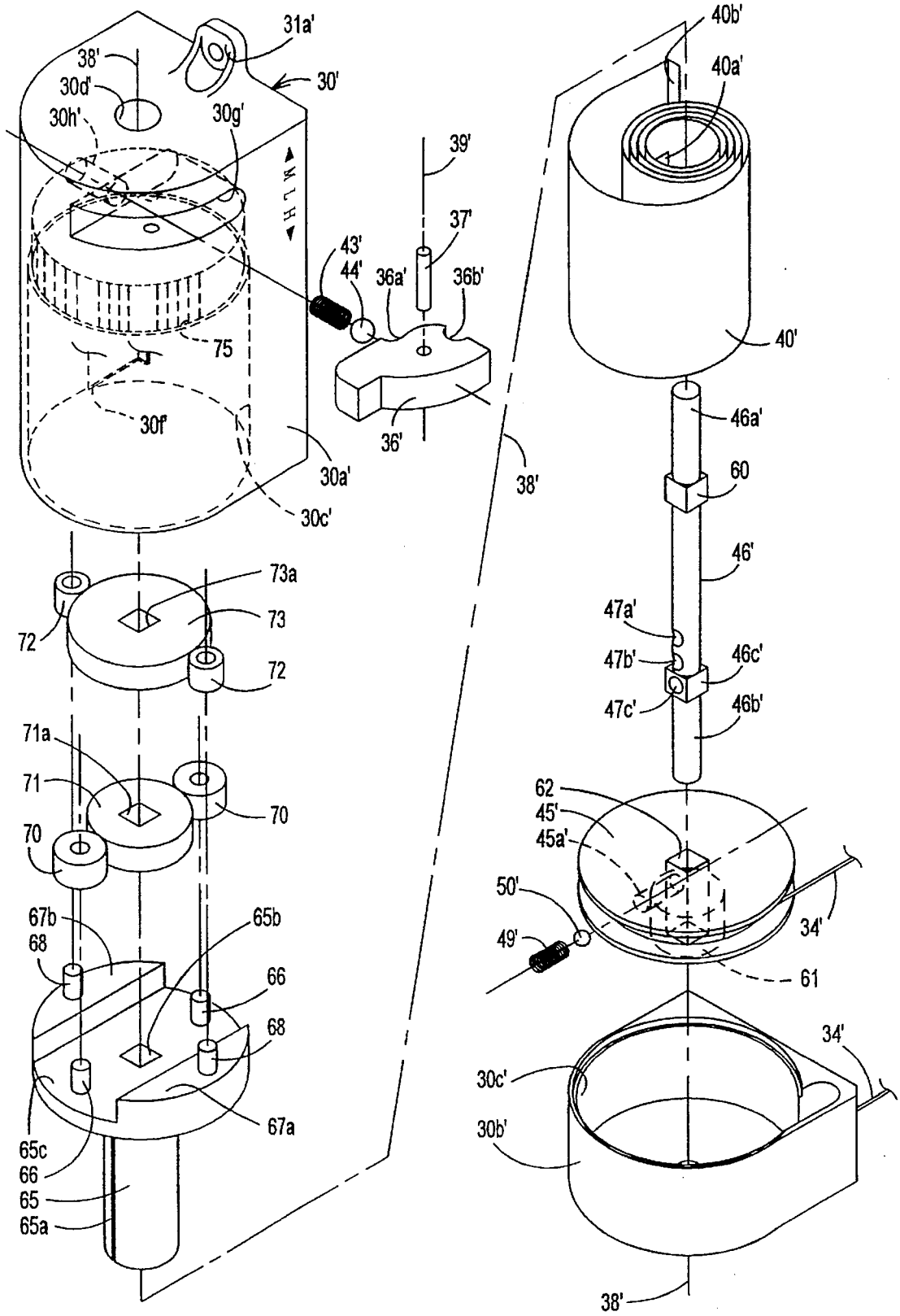
FIG. 12 is an exploded diagrammatic isometric view of the closure housing assembly of FIG. 11.

A second embodiment of a selectably adjustable tension screen panel closure apparatus is illustrated in FIGS. 11 and 12. Referring thereto, elements that perform comparable functions or are generally similar in nature to those described with respect to the first embodiment are represented by the same numerals as used for the first embodiment, with a prime (') designation. The closure housing 30' of the second embodiment includes upper and lower housing portions 30*a'* and 30*b'* cooperatively matable and secured together to define an internal cavity 30*c'* that houses the operatively movable parts of the closure assembly. As with the first embodiment, the upper and lower housing portions respectively define axially aligned upper and lower cylindrical holes 30*d'* and 30*e'* for cooperatively slidably guiding an elongate spindle 46' member for movement along a central axis 38'. In the preferred embodiment illustrated, the spindle 46' is generally cylindrical in shape, and includes two intermediate square or spline cross-sectional key portions, the upper such portion being designated as 60, and the lower such key portion being designated as 46*c'*. As with the first embodiment, the upper and lower cylindrical extremities of the spindle 46' are respectively designated as 46a' and 46b'. The operative components of the assembly are generally centered about and coaxially aligned about the spindle 46' and about the central axis 38'.

The second embodiment closure apparatus uses a single "power" spring 40' to provide biasing tension to a cord or cable 34', and adjusts the tension provided to the cable 34' by changing the tensioning applied to spring 40' through two selectable planetary gear arrangements. In the preferred embodiment, the spring 40' is 0.005 inches thick, 1.5 inches wide and 100 inches long. In the second embodiment, the reel or take-up spool 45' for the tension cable 34' is inverted with respect to that previously described for the first embodiment, and has a cylindrical extension 61 extending downwardly along the axis 38' and rotatably seats against the inside lower surface of the cavity 30c'. As with the spool 45 of the first embodiment, the spool 45' includes an interior radially aligned cylindrical opening 45a' which operatively houses a detent ball 50' and its associated biasing coil spring 49'. The spool 45' and cylindrical extension cooperatively define an interior axial keyway 62 having a square or spline cross-sectional shape cooperatively slidably engage and mate with the lower square key portion 46c' of the spindle 46'. The spindle 46' also includes three spaced and aligned semispherical detent holes 47a', 47b' and 47c' in its outer surface which are aligned, sized and configured to matingly accept the detent ball 50'.

The main spring 40' rests upon the upper surface of the take-up spool 45' and is operatively connected to and wound around a main spring arbor 65 which is similar in function to the main spring arbor 48 of the first embodiment, except that it rotates independently of the take-up spool 45'. The main spring arbor 65 includes a longitudinal slot 65a extending inwardly from its outer surface for retainably engaging the inner end 40a' of the power spring 40'. The outer end 40b' of the power spring is retainably engaged within an L-shaped slot 30f' extending from the inner cavity 30c' of the upper housing member 30a' in a manner such that the power spring 40' is wound or increased in tension as the arbor 65 rotates in a counterclockwise direction, corresponding to withdrawal of the cable 34' from the take-up spool 45'. The interior axial keyway 65b of the arbor 65 is also of square cross-sectional shape which cooperatively slidably mates with the outer shape of the upper square key portion 60 of the spindle 46'.

The upper portion of the arbor 65 defines an expanded disk-shaped member having a diameter sized to freely rotate within the inner cavity 30c' of the housing 30', and defines the seats for two levels of planetary gears. The first or lower such level comprises the land area generally designated at 65c from which project a pair of vertical shafts 66. A first pair of identically sized planetary gears 70 are rotatably mounted to the shafts 66 and cooperatively engage a first sun gear 71 which has an axial square keyway 71a formed therethrough cooperatively sized to slidably matingly engage the square key section 60 of the spindle 46', and which is axially aligned with the central axis 38'. When operatively positioned within the housing 30' as illustrated in FIG. 11, the planetary gears 70 operatively cooperatively mesh with an annular gear tooth ring 75 peripherally disposed around and forming a fixed portion of the interior surface of the housing cavity 30c'. The first land area 65c forms a slidable seat for the planetary gears 70 and the first sun gear 71. In the preferred embodiment, the first planetary gears 70 each has 23 teeth, the first sun gear 71 has 46 teeth, and the peripheral ring gear 75 has 92 teeth.

The upper seat or land surfaces defined by the coplanar surfaces 67a and 67b of the power spring arbor member 65 slidably support a second pair of planetary gears 72 and their associated sun gear 73. A pair of vertical shafts 68 extending from the second land areas 67a and 67b hold the planetary gears 72 for rotation about their respective axes. When operatively assembled on the shafts 68 within the inner cavity 30c' of the housing 30', the planetary gears 72 cooperatively engage the teeth of the ring gear 75 and their associated sun gear 73. In the preferred embodiment, the planetary gears 72 each has 15 peripheral teeth, and their associated sun gear 73 has 62 teeth. The interior keyway of the sun gear 73 is identical in shape with that of the first sun gear 71 and is designed to cooperatively selectably engage the square key member 60 of the spindle 46', depending upon the vertical position of the spindle.

As with the first embodiment of the closure assembly, the upper housing 30a' is configured to operatively mount a door catch member 36' and its associated catch ball 44' and biasing spring 43', which are configured and operate in the manner previously described with respect to the first embodiment.

The planetary gear embodiment of the closure apparatus referred to in FIGS. 11 and 12 is similar in operation to the multiple power spring embodiment previously described, in that adjustment of the tensioning force is selected by vertical movement of the spindle 46'. When positioned in its lowermost position as illustrated in FIG. 11, with the detent ball 50' engaging the uppermost detent notch 47a', the spindle is positioned to rotatably engage the take-up reel 45' through its cylindrical extension 61 by reason of engagement therewith by the squared key portion 46c' of the spindle. The spindle also operatively engaged the power spring arbor 65 by direct engagement therewith of the squared key section 60 of the spindle 46'. In such position, the power spring 40' will deliver maximum tension to the cord 34' through its take-up reel 45'.

As the spindle 46' is axially raised one detent position such that the detent ball 50' cooperatively engages the middle detent notch 47b', the spindle assembly 46' will be operatively engaged to the take-up reel 45' and the first sun gear 71, which is engaged by the squared key portion 60 of the spindle assembly. In such position, as the take-up reel rotates with extraction of the cord 34', the spindle assembly 46' will rotate the first sun gear 71, causing the sun gear 71 to rotate its pair of planetary gears 70, thereby causing the spring arbor 65 to rotate by reason of forces applied thereto through the pin members 66. Due to the gear reduction ratio provided by the sun 71 and planetary 70 gears, the spring arbor 65 will rotate at a slower rate than the take-up reel and spindle assembly, thereby providing reduced tension to the cord 34' than is provided when the spindle is in its lowermost position.

As the spindle is raised to its uppermost position corresponding to the detent ball 50' cooperatively engaging the lowermost detent notch 47c', the spindle assembly will simultaneously engage the take-up reel and the uppermost or second sun gear 73. When rotated, the sun gear 73 causes its planetary gears 72 to rotate and to impart a rotary motion to the spring arbor 65 through their associated pins 68. As will become apparent upon examination of the relative planetary gear sizes illustrated in FIGS. 11 and 12, since the first pair of planetary gears 70 are larger in diameter than the second set of planetary gears 72, the middle setting of the spindle assembly will cause the least amount of spring bias to be applied to the cord 34'. The uppermost setting of the spindle assembly will provide a mid-range level of tension to the take-up reel and cord 34'.

In the preferred embodiment illustrated, and using the planetary gear ratios, the spring tension applied to the cord 34' for the second embodiment of the closure apparatus, when operative in its highest tension mode, is about 1.8–2.7 pounds, and more preferably about 2.5 pounds. When operative in its medium mode, the applied tension is about 1.2–1.8 pounds and more preferably about 1.7 pounds. When operative in its lower tension mode, the tension is about 1–1.4 pounds and more preferably about 1.25 pounds. Obviously, the maximum tension is a function of the spring parameters as well as the take-up reel spring arbor and housing sizing, and the degree of tension reduction is a function of the gear reduction sizing of the planetary gear subassemblies.

In similar manner to that previously described with respect to the first embodiment closure apparatus, when the operator releases the screen panel 20 after an opening operation, the tensioned or wound spring 40' will exert pressure, either directly or through that planetary gear assembly with which it is connected, to the spindle assembly 46', which will transmit such rotational force to the take-up reel 45' to cause the take-up reel to rotate in a clockwise direction to rewind or withdraw the cable 34' back into the housing 30', thereby closing the screen panel member in its door assembly.

For the gear sizes and tooth ratios described with respect to the second embodiment of the invention, when set for operation in its "high" tension mode, the take-up reel moves at the same rotational speed as the spring arbor. When set for operation in its "low" tension mode, the take-up reel rotates twice as fast as the spring arbor. When set for operation in its "medium" tension mode, the take-up reel moves at 1.5 times the speed of rotation of the spring arbor.

Figure 13:
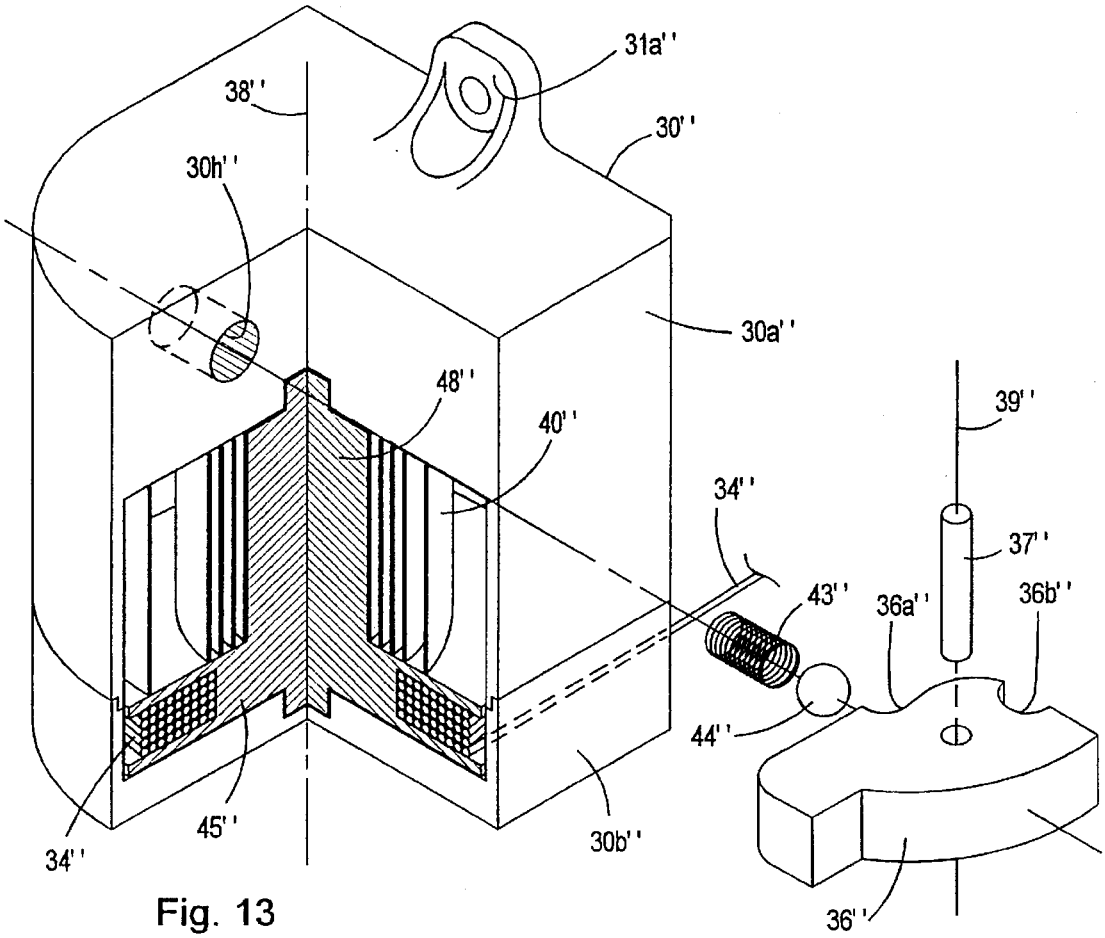
FIG. 13 is an enlarged generally quarter-sectional isometric view similar to that of FIG. 9, of a third embodiment of the closure housing assembly of FIG. 8, with the door catch and biasing portions thereof separated for clarity therefrom.
Figure 14:
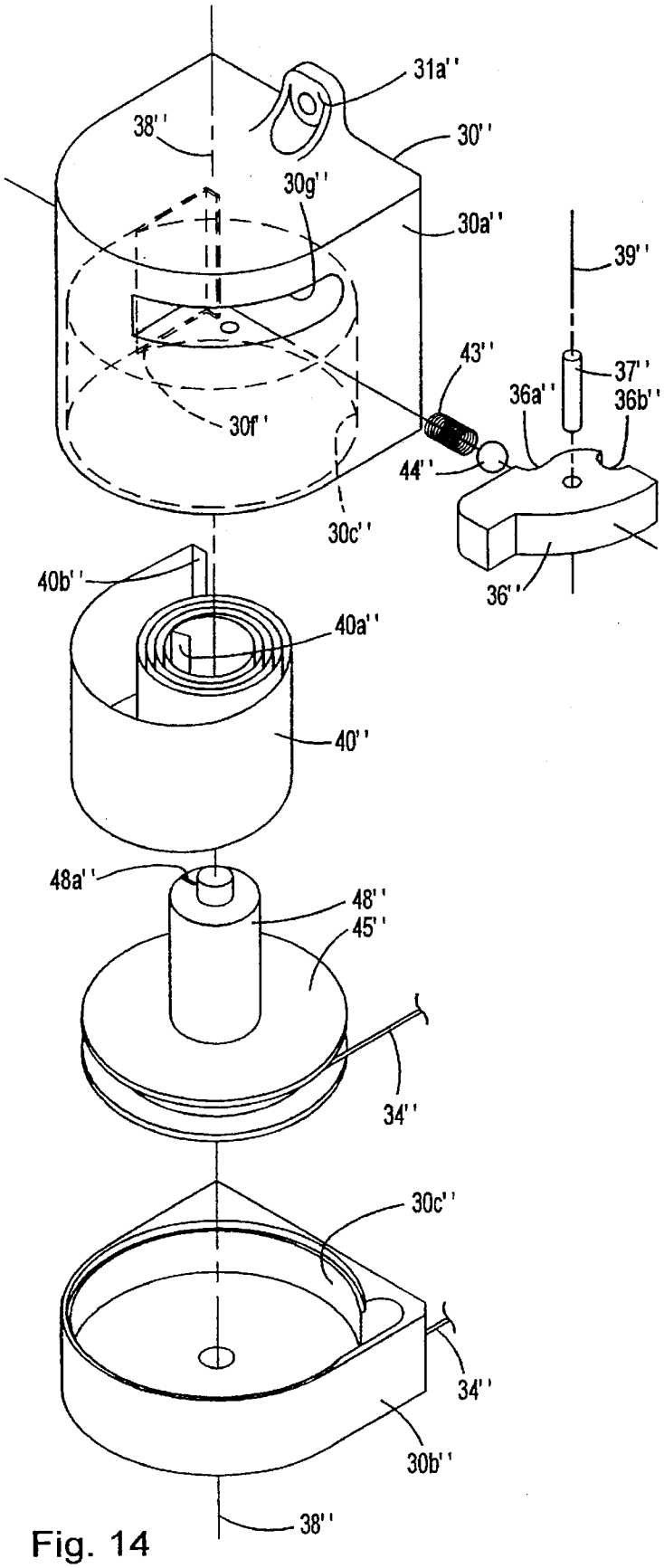
FIG. 14 is an exploded diagrammatic isometric view of the closure housing assembly of FIG. 13.

A simplified third embodiment of the invention, which does not include any cable tensioning adjustment or selection features is illustrated in FIGS. 13 and 14. Referring thereto, the closure housing 30" includes upper and lower housing portions **30*a*" and 30*b*" respectively, which are secured together and cooperatively define an internal cavity 30*c*" for housing the operative components of the assembly. A take-up reel or spool assembly 45" is similar in construction to the take-up spool previously described with respect to the first embodiment, and includes an integrally connected power spring arbor extension 48" to which a spirally wound "power" spring 40" is operatively connected in manner identical to that previously described with respect to the first embodiment. In the preferred embodiment, the spring 40" is 0.005 inches thick, 0.75 inches wide and 158 inches long. The upper and lower portions of the take-up spool 45" and the power spring arbor 48" define axially aligned cylindrical extensions which are configured to rotatably ride within cooperatively defined and axially aligned cylindrical seats formed within the upper and lower housing members 30*a*" and 30*b*" respectively, such that the entire take-up reel 45" and arbor 48" assembly freely rotates within the housing about the central axis 38". The upper housing member 30*a*" also includes an elongate L-shaped slot 30*f*" extending from its inner cavity 30*c*"** for retainably engaging the outer end of the power spring, in manner previously described.

The upper housing member **30*a*" is also configured to cooperatively accept a door catch cam member 36" and its associated detent ball 44" and biasing spring 43"** assembly in identical manner to that previously described with respect to the first and second embodiments.

Operation of the third embodiment of the invention is relatively straightforward. Rotation of the take-up reel 45" is directly coupled to the spring arbor 48" for tensioning the spring 40" or for enabling the spring 40" to apply tension to the take-up reel 45".

It will be noted that the "depth" of the spool 45" is significantly deeper for the third embodiment spool 45" relative to the spools 45 and 45' of the first and second embodiments, which provided "switchable" selection of three different cord tensions. The "deeper" spool 45" enables a longer length of cord to be wound thereon. Some degree of adjustable cord tensioning is thus provided with this embodiment by enabling a length of cord to be withdrawn from the spool prior to operatively connecting the cord to the sliding panel member. Such withdrawal in effect "preloads" or "pretensions" the power spring and thereafter "changes" the cord tension by reducing the effective spool diameter, thus causing the spring arbor to rotate more per given length of cord withdrawn. The excess cord that is withdrawn is simply wound on the cord retainer bracket 32 (FIG. 15), as hereinafter described, in an unobtrusive manner.

Figure 15:
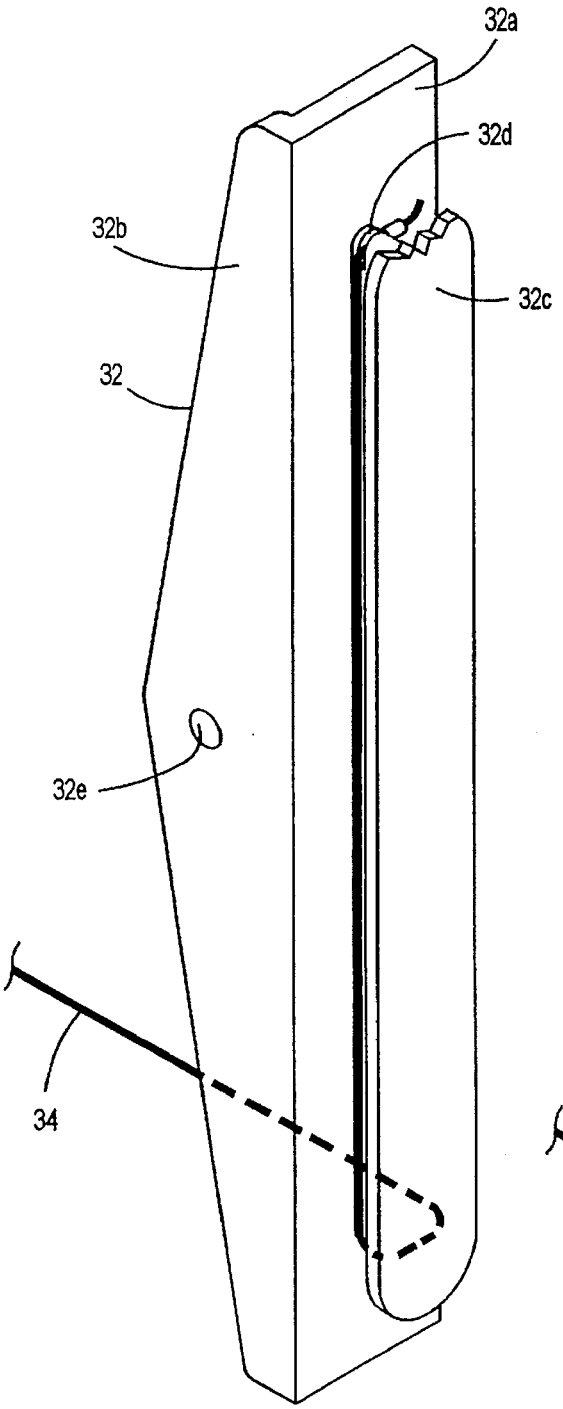
FIG. 15 is an enlarged isometric view with portions thereof broken away, of a first embodiment of the cord retainer bracket portion of the closure assembly illustrated in FIG. 1.
Figure 16:
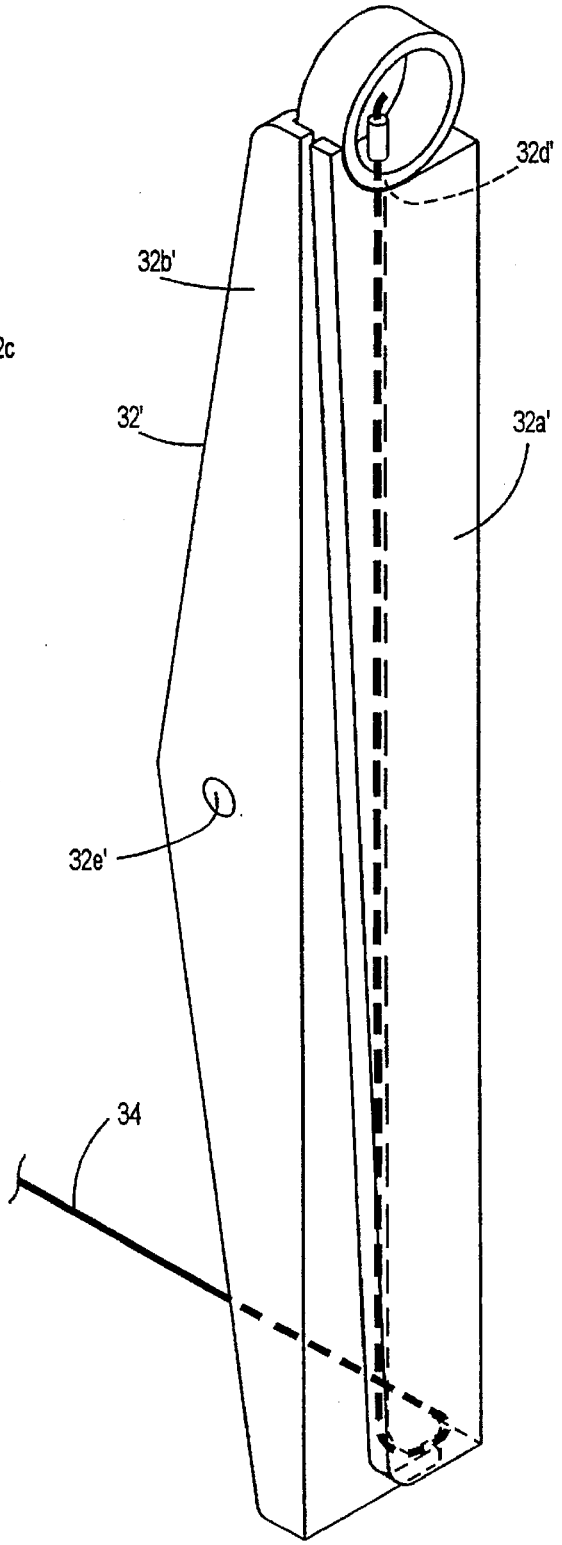
FIG. 16 is an enlarged isometric view of a second embodiment of the cord retainer bracket of the closure assembly of FIG. 1.

Several preferred embodiments of the cord retainer bracket 32 are illustrated in FIGS. 15 and 16. Referring thereto, a first preferred embodiment of a cord retainer bracket 32 is illustrated in FIG. 15. This embodiment of the retainer bracket is particularly useful with the third embodiment closure assembly 30" (illustrated in FIGS. 13 and 14) just described, since it is configured to retainably hold an excess length of "withdrawn" cord. The bracket simply comprises an L-shaped bracket having a first leg **32*a* configured to be placed against the end surface of the upright trailing member 21*b* of the screen panel frame 21, and a second leg 32*b* formed at a right angle to the first leg 32*a* for resting against the front surface of the upright trailing member 21*b* for fastening thereto. The second leg 32*b* has a hole defined therethrough, through which an appropriate screw or bolt member is inserted to secure the bracket 32 to the screen door frame, as illustrated in FIGS. 1 and 8. The preferred embodiment of the bracket 32 includes a raised T-shaped spool member 32*c* outwardly projecting from the outer surface of the first leg portion 32*a* for entraining and protecting the end portion of the cable or cord 34 (indicated in dashed lines) therealong and for providing the desired degree of "preloading" tension to the cord and its associated spring biasing portions of the system. The end of the cord is secured within a notch or groove 32*d*, at one end of the raised section 32*c*, and the cord is wound around the raised spool portion 32*c*** as necessary to effect the desired preloading tension on the power spring(s).

A second preferred embodiment of the cord retainer bracket is indicated at 32' in FIG. 16. The cord retainer bracket 32' is particularly useful with the selectably adjustable tensioning closure assemblies illustrated in FIGS. 9–12, to preload the power springs within the housing. The bracket 32' is similar in L-shaped construction to the first described bracket 32 and simply entrains the cord 34 within an elongated groove up to the engagement groove **32*d'*** for retainably holding the end of the cord.

While the present invention has been described with respect to several preferred embodiments of closure systems which practice the principles of the invention, it will be understood by those skilled in the art, that the invention is not to be limited to such preferred embodiments, or to any particular selected spring tension or reduction gear ratios disclosed with respect thereto. Such descriptions have been set forth for the purposes of illustration only. The invention is to be limited solely by the scope of the appended claims.

What is claimed is:

1. An automatic closure apparatus for a sliding panel having a top slide and bottom slide and being mounted for sliding movement relative to an opening having a predetermined height, said closure apparatus comprising:

(a) a cord retainer sized and configured for attachment intermediate the top slide and bottom slide and being mountable to a first edge of the sliding panel; and (b) a compact closure assembly sized and configured for attachment to a non-movable object intermediate the top slide and bottom slide and adjacent to that side of the opening addressed by said first edge of the sliding panel when positioned so as to close the opening, said closure assembly including:

(i) a compact housing having a wall defining an internal cavity and having a cord opening therethrough; said housing being configured for mounted to said non-movable object;

(ii) a rotatable take-up reel mounted within said housing and being rotatable about an axis and having a wound length of cord thereon;

(iii) a cord having an end, said cord being initially wound on said take-up reel and passing through said cord opening, said cord end for securement to said cord retainer; and (iv) at least one power spring having an inner end and an outer end located within said internal cavity of said housing, said inner end of said power spring cooperatively engaging said rotatable take-up reel and said outer end engaging said wall of said compact housing whereby, said power spring is placed in tension as said take-up reel rotates to release said wound length of cord therefrom thereby applying torque to said take-up reel to thereby retract said cord back onto said take-up reel; said power spring being mounted and being operational in its generally linear torque range.

2. The closure apparatus of claim 1, wherein said closure assembly further comprises:

(a) a plurality of said at least one power spring operatively connectable to said take-up reel; and (b) mechanical selection means mounted to said housing for selectively operatively engaging said plurality of power springs to said takeup reel for selectively changing the torque applied by said at least one power springs to said take-up reel.

3. The closure apparatus of claim 2, wherein said mechanical selection means includes a selector movable between discrete switch positions for enabling an operator to select desired ones of said discrete positions corresponding to differently unique levels of torque applied to said take-up reel.

4. The closure apparatus of claim 2, wherein said mechanical selection means includes spindle means longitudinally movable, for selectively operatively engaging different ones of said plurality of said at least one power springs to said take-up reel.

5. The closure apparatus of claim 2 wherein said selection means operatively provides at least three different selections of said torque applied to said take-up reel.

6. The closure apparatus of claim 1, including mechanical selection means having gear reduction means mounted within said housing for selectively operably changing the torque applied by said power spring to said take-up reel.

7. The closure apparatus of claim 6, wherein said selection means further comprises spindle means mounted to said housing, said spindle means being longitudinally movable to have various longitudinal positions and being operatively connected with said gear reduction means, for selectively operatively engaging different gears of said gear reduction means to said power spring depending upon the longitudinal position of said spindle means.

8. The closure apparatus of claim 6 wherein said selection means operatively provides at least three different selections of said torque applied to said take-up reel.

9. The closure apparatus of claim 1, wherein said sliding panel has a sliding movement path and said closure apparatus further comprising stop means, mounted to said housing and movable across said sliding movement path of said panel, for selectably retainably holding the sliding panel in a fully open position.

10. The closure apparatus of claim 1, wherein the tension force applied by said power spring is from about 1 to 2.7 pounds.

11. An automatic closure apparatus being constructed and arranged for operation intermediate the top and bottom of a sliding door panel, comprising:

(a) a compact housing having a wall defining an internal cavity and being constructed and arranged for mounting to a surface of an object in proximity to the sliding door panel;

(b) a cord;

(c) a take-up reel means rotatably mounted to said housing and releasably holding said cord for withdrawal from and retraction back into said housing;

(d) a power spring mounted within said internal cavity of said housing, said power spring having an inner end and an outer end said outer end engaging said wall of said compact housing and being fixed with respect thereto;

(e) coupling means operatively interconnecting said inner end of said power spring and being constructed and arranged to move with said take-up reel means such that said power spring applies rotational torque forces to said take-up reel means whenever said take-up reel means has been rotated due to cord withdrawal therefrom from an initial full cord retraction position; and (f) means connecting said cord to said sliding door panel wherein said cord is withdrawn from said take-up reel means when said sliding door panel is moved in an opening direction and is retracted by said take-up reel means when said sliding door panel is moved in a closing direction.

12. The closure apparatus of claim 11, wherein a rotational torque force is applied to said take-up reel means and wherein said coupling means includes selection means for selectively changing said rotational torque force applied to said take-up reel means.

13. The closure apparatus of claim 12, wherein said selection means includes a gear reduction means.

14. The closure apparatus of claim 13, wherein said selection means is operable to engage said gear reduction means so as to provide at least two different discrete torque forces to said take-up reel means.

15. The closure apparatus of claim 13, wherein said selection means is operable to engage said gear reduction means so as to provide at least three different discrete torque forces to said take-up reel means.

16. The closure apparatus of claim 12, wherein said rotational torque force applied to said take-up reel means can be selected so as to provide a tension force to said cord within the range of about 1.0 to 2.7 pounds.

17. The closure apparatus of claim 11, wherein said apparatus includes a plurality of said power springs mounted within said housing; wherein said coupling means includes selection means for operatively connecting selected ones of said plurality of power springs for movement with said take-up reel means; and wherein the rotational torque force applied to said take-up reel means can be selectively varied by an operator.

18. The closure apparatus of claim 17, wherein said selection means includes a longitudinally movable spindle, movable between discrete positions, each corresponding to a different torque force applied by said power springs to said take-up reel means.

19. The closure apparatus of claim 18, wherein said spindle is selectably movable to define at least two different torque forces.

20. The closure apparatus of claim 18, wherein said spindle is selectably movable to define at least three different torque forces.

21. A door assembly having an automatically dosing movable panel, comprising:

(a) a frame, defining an opening;

(b) at least one movable panel operatively slideably mounted to said frame and being movable relative to said opening; and (c) an automatic closure apparatus operative between said frame and said at least one movable panel including:

(i) a cord retainer attached to a first edge of said movable panel; and (ii) a compact closure assembly attached to a nonmovable object adjacent to that side of the opening addressed by said first edge of said movable panel when positioned so as to close the opening, including:

(A) a compact housing having a wall defining an internal cavity and having a cord opening therethrough; said housing being mounted to said nonmovable object;

(B) a take-up reel mounted within said housing and being rotatable about an axis and having a wound length of cord thereon;

(C) a cord having an end, said cord being wound on said take-up reel and passing through said cord opening, said cord end being secured to said cord retainer; and (D) at least one power spring within said internal cavity of said housing said power spring having an outside end engaging said wall of said housing and said power spring having an inner end cooperatively engaging said take-up reel, such that said power spring is placed in tension as said take-up reel rotates to release the wound cord therefrom thereby applying torque to said take-up reel to retract said cord back onto the take-up reel; said power spring being mounted and selected and being operational in its generally linear torque range.

* * * * *